US010814244B2

(12) United States Patent
Wu et al.

(10) Patent No.: US 10,814,244 B2
(45) Date of Patent: Oct. 27, 2020

(54) WIRELESS REMOTE CONTROL ORBITER BASED ON 5G FREQUENCY BAND

(71) Applicant: ZHEJIANG DAFENG INDUSTRY CO., LTD., Yuyao, Zhejiang Province (CN)

(72) Inventors: Jin Wu, Yuyao (CN); Xiaoyin Liu, Yuyao (CN); Xiaojun Wang, Yuyao (CN); Qifei An, Yuyao (CN); Jianming Xu, Yuyao (CN); Yinghai Song, Yuyao (CN); Shuyong Zhang, Yuyao (CN); Yanku Wang, Yuyao (CN)

(73) Assignee: ZHEJIANG DAFENG INDUSTRY CO., LTD., Yuyao, Zhejiang Province (CN)

( * ) Notice: Subject to any disclaimer, the term of this patent is extended or adjusted under 35 U.S.C. 154(b) by 0 days.

(21) Appl. No.: 15/166,659

(22) Filed: May 27, 2016

(65) Prior Publication Data

US 2016/0346710 A1 Dec. 1, 2016

(30) Foreign Application Priority Data

May 28, 2015 (CN) ..... 2015 1 0283018

(51) Int. Cl.

| | |
|---|---|
| ***A63J 5/12*** | (2006.01) |
| ***B66D 3/04*** | (2006.01) |
| ***B66D 3/00*** | (2006.01) |

(52) U.S. Cl.

CPC *A63J 5/12* (2013.01); *B66D 3/00* (2013.01); *B66D 3/04* (2013.01)

(58) Field of Classification Search

CPC ..... A63J 5/12; A63J 5/02; A63J 5/028; A63J 19/00; A63J 19/006; A63J 2019/003; A63G 31/16; B66D 3/04; B66D 3/00

USPC ..... 248/330.1; 472/80, 130; 254/331, 393, 254/413

See application file for complete search history.

(56) References Cited

U.S. PATENT DOCUMENTS

| | | | | |
|---|---|---|---|---|
| 4,392,648 | A * | 7/1983 | Foy | A63J 5/12 212/74 |
| 6,520,485 | B1 * | 2/2003 | Soot | A63J 1/028 160/331 |
| 7,484,712 | B2 * | 2/2009 | Hossler | A63J 1/028 254/331 |
| 7,886,920 | B2 * | 2/2011 | Colley | A63J 5/12 212/316 |
| 8,596,616 | B1 * | 12/2013 | Soot | B66D 1/39 254/334 |

(Continued)

*Primary Examiner* — Nkeisha Smith

(74) *Attorney, Agent, or Firm* — Gearhart Law LLC

(57) ABSTRACT

The present application describes a wireless remote orbiter based on a 5G frequency band. The orbiter may have a main rail which is fixedly mounted on bearing beam of stage and a rack which is mounted with translational drive means and lifting drive means. The main rail comprises a vertical rail and a horizontal rail which is formed integrally below the vertical rail, load-bearing wheels are fixedly mounted on the rack against the upper of the horizontal rail, translational friction wheel groups are connected to the translational drive means against the vertical rail, the lifting drive means are connected to a dual rope hoisting mechanism. A sliding contact line is laid with the rail on the main rail. A collector supplied power from sliding contact line conductor is mounted on the rack.

7 Claims, 5 Drawing Sheets

(56) References Cited

U.S. PATENT DOCUMENTS

| | | | | |
|---|---|---|---|---|
| 8,636,265 | B1 * | 1/2014 | Soot | B66D 1/39 254/334 |
| 8,684,854 | B2 * | 4/2014 | Fisher | A63J 5/12 472/130 |
| 2013/0109484 | A1 * | 5/2013 | Fisher | A63J 5/00 472/80 |
| 2015/0316921 | A1 * | 11/2015 | Atherton | G05B 19/4065 700/114 |
| 2015/0368074 | A1 * | 12/2015 | Sturm | B66C 13/06 212/312 |

* cited by examiner

WIRELESS REMOTE CONTROL ORBITER BASED ON 5G FREQUENCY BAND

CLAIM OF PRIORITY

This application claims priority to Chinese Application 201510283018.1 filed of May 28, 2015, the contents of which is herein fully incorporated by reference in its entirety.

FIELD OF THE EMBODIMENTS

The present invention and embodiments relate to the field of stage performing arts device, and more particularly to a wireless remote control orbiter based on 5G frequency band.

BACKGROUND OF THE EMBODIMENTS

An orbiter is a common device in venues for performing arts. The main function of the orbiter is to lift the actors or props for performing in air. Because general orbiter moves with towing wire rope, turning, twisting, and releasing of the cable used for power and control are difficult (easy to wound and interfere with each other), the rails are straight, and the route is relatively short, and the running speed is slow. So these orbiters only move in two-dimensional in a vertical plane. The artistic expression in the performing arts is very limited.

SUMMARY OF THE EMBODIMENTS

At least one technical problem to be solved by the present patent application is to provide a wireless remote orbiter based on 5G frequency band which can run smoothly with high speed, and low noise, realizing curve motion.

In order to solve the above problem(s), the present invention and its embodiments provides a wireless remote control orbiter based on 5G frequency band, the orbiter comprises a main rail which is fixedly mounted on a bearing beam of stage and a rack which is mounted with translational drive means and lifting drive means. The main rail comprises a vertical rail and a horizontal rail which is formed integrally below the vertical rail. Load-bearing wheels are fixedly mounted on the rack against the upper of the horizontal rail. Translational friction wheel groups are connected to the translational drive means against the vertical rail. The lifting drive means are connected to the hoisting mechanism. A sliding contact line is laid with the rail on the main rail, a collector supplied power from the sliding contact line conductor is mounted on the rack.

Wherein, the translational friction wheel groups comprise a main translational friction wheel which is mounted on the translational drive means, a first bearing pedestal for supporting the main translational friction wheel, a second bearing pedestal which is articulated on the first bearing pedestal and a driven translational friction wheel which is supported on the second bearing pedestal by bearing. The main translational friction wheel and the driven translational friction wheel separately lean against both sides of the vertical rail.

Wherein, a first tension spring is disposed between the first bearing pedestal and the second bearing pedestal.

Wherein, a plurality of horizontal stable wheel groups are disposed on the rack, each of the horizontal stable wheel group comprises two horizontal stable wheels which are movably mounted on the rack, the two horizontal stable wheels separately lean against both sides of the vertical rail.

Wherein, a horizontal affiliated rail is fixedly mounted on the main rail, a plurality of vertical stable wheels are disposed on the rack, each of the vertical stable wheel group comprises two vertical stable wheels which are movably mounted on the rack, the two vertical stable wheels separately lean against both sides of the affiliated rail.

Wherein, the orbiter further comprises a ranging mechanism. The ranging mechanism comprises a ranging synchronous belt which is fixedly mounted on the main rail, and a belt wheel which is meshed with the ranging synchronous belt, and a first encoder which is connected to the belt wheel. The belt wheel is movably mounted on the rack.

Wherein, a second tension spring is disposed on the rack. One end of the second tension spring is connected to the rack, and another end is connected to the belt wheel.

Wherein, a remote control signal receiver is disposed on the rack. The remote control signal receiver receives wireless signal on 5G frequency band.

Wherein, a first limit switch is separately mounted on the two ends of the rack for preventing translational collision.

Wherein, a hoisting limit block is disposed on the hoisting mechanism. A second limit switch is mounted above the hoisting limit block on the rack for anti-hoisting of lifting.

Compared with the known solutions, the present patent application has the following characteristics:

(1) high speed (speed up to 2 m/s);
(2) smooth running, low noise (running noise≤50 dB);
(3) running on the curves, (the minimum turning radius≤4 m);
(4) high positioning accuracy, (repetitive positioning accuracy≤6 mm);
(5) hanging stably, non-rotating and small swaying; and
(6) wireless controlling based on 5G frequency band, and anti-jamming performance is superior.

DETAILED DESCRIPTION OF EMBODIMENTS

Below with reference to the accompanying drawing and embodiments, specific embodiments of the present patent application will be described in further detail. The following embodiments illustrate the patent application but not to limit the scope of the present patent application.

Figure 1:
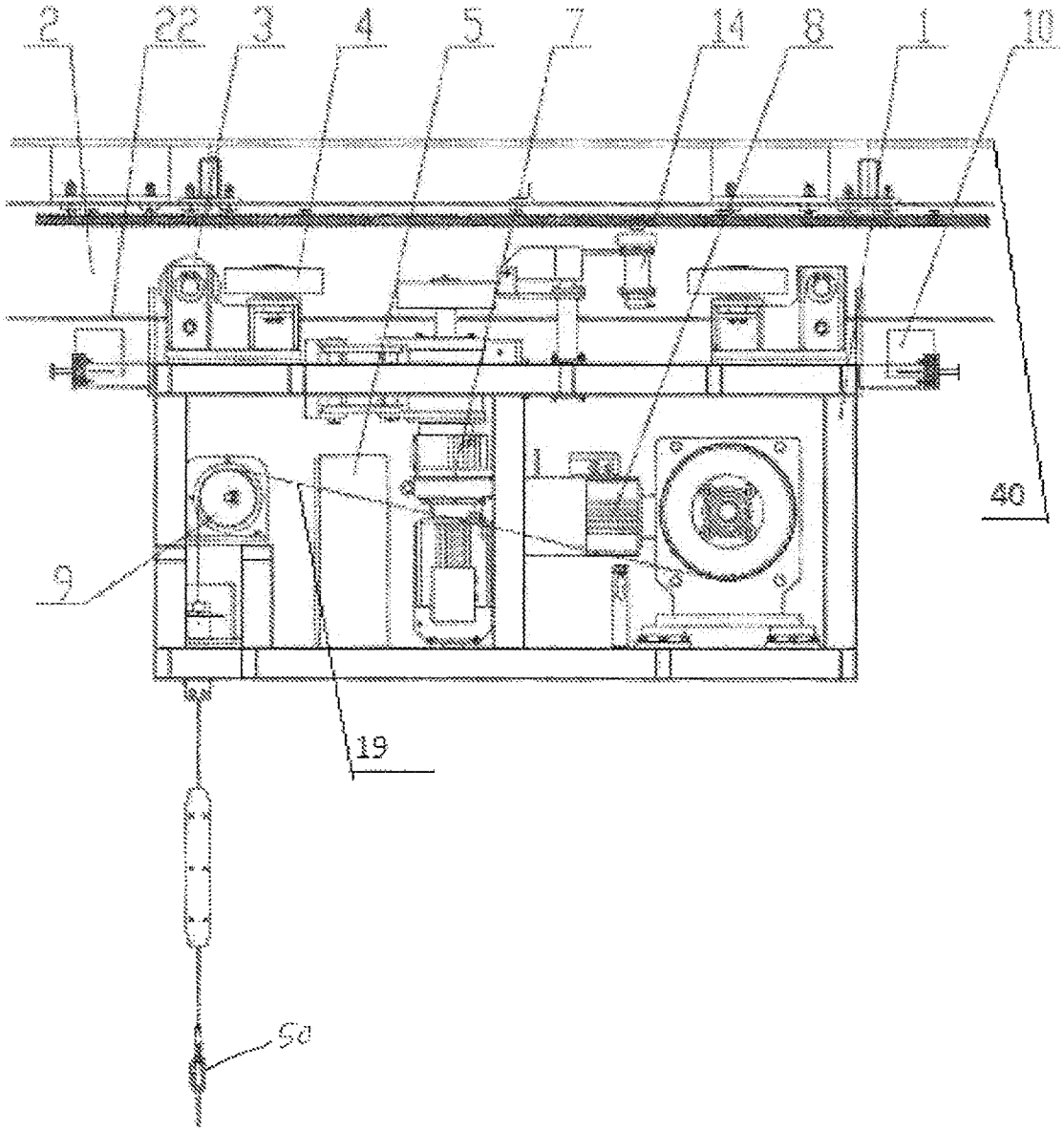
FIG. 1 is a frontal structure schematic diagram of the wireless remote control orbiter based on 5G frequency band of the present patent application.
Figure 2:
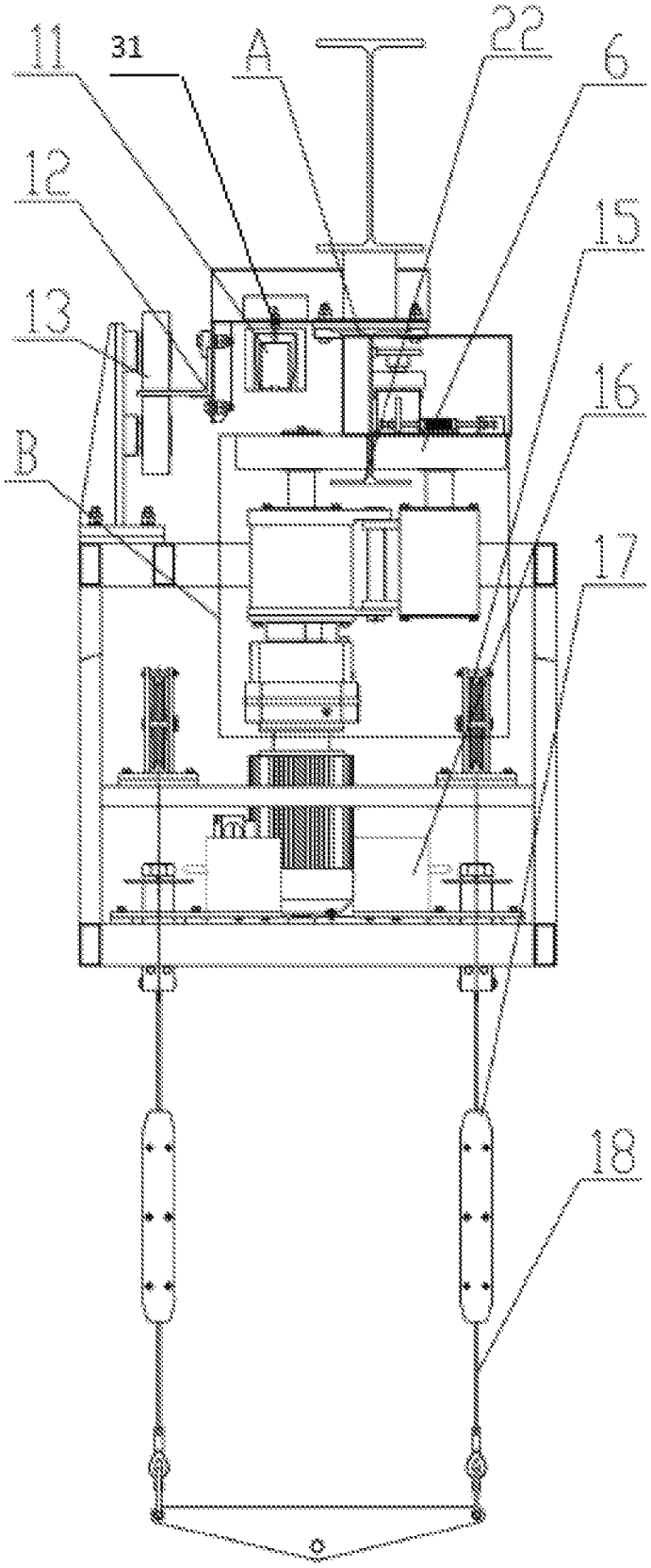
FIG. 2 is a left structure schematic diagram of the wireless remote control orbiter based on 5G frequency band of the present patent application.

The structure of the wireless remote control orbiter based on 5G frequency of the present patent application is shown in FIGS. 1 and 2. The wireless remote control orbiter based on 5G frequency band comprises a main rail 2 which is fixedly mounted on bearing beam of stage 40, and rack 1 which is mounted with translational drive means 7 and lifting drive means 8. The main rail 2 comprises a vertical rail 21 and a horizontal rail 22 which is formed integrally below the vertical rail 21. Load-bearing wheels 3 are fixedly mounted on the rack 1 against the upper of the horizontal rail 22. Translational friction wheel groups 6 are connected to the translational drive means 7 against the vertical rail 21. The lifting drive means 8 are connected to a hoisting mechanism 9. A hanging tool (not shown) is connected to below the wire rope 19 of the hoisting mechanism 9. A sliding contact line 11 is laid with the rail on the main rail 2. A conductor 31 is mounted on the rack 1. So the hanging tool is not dragged by cables, and also the reliability of electricity supply and operational safety are improved, high-speed running can be realized, speed up to 2 m/s.

A corner pulley 15 which can guide the wire rope of the hoisting mechanism is provided on the rack 1 to ensure the wire rope can hoist smoothly and thereby avoid getting stuck and so on.

Figure 3:
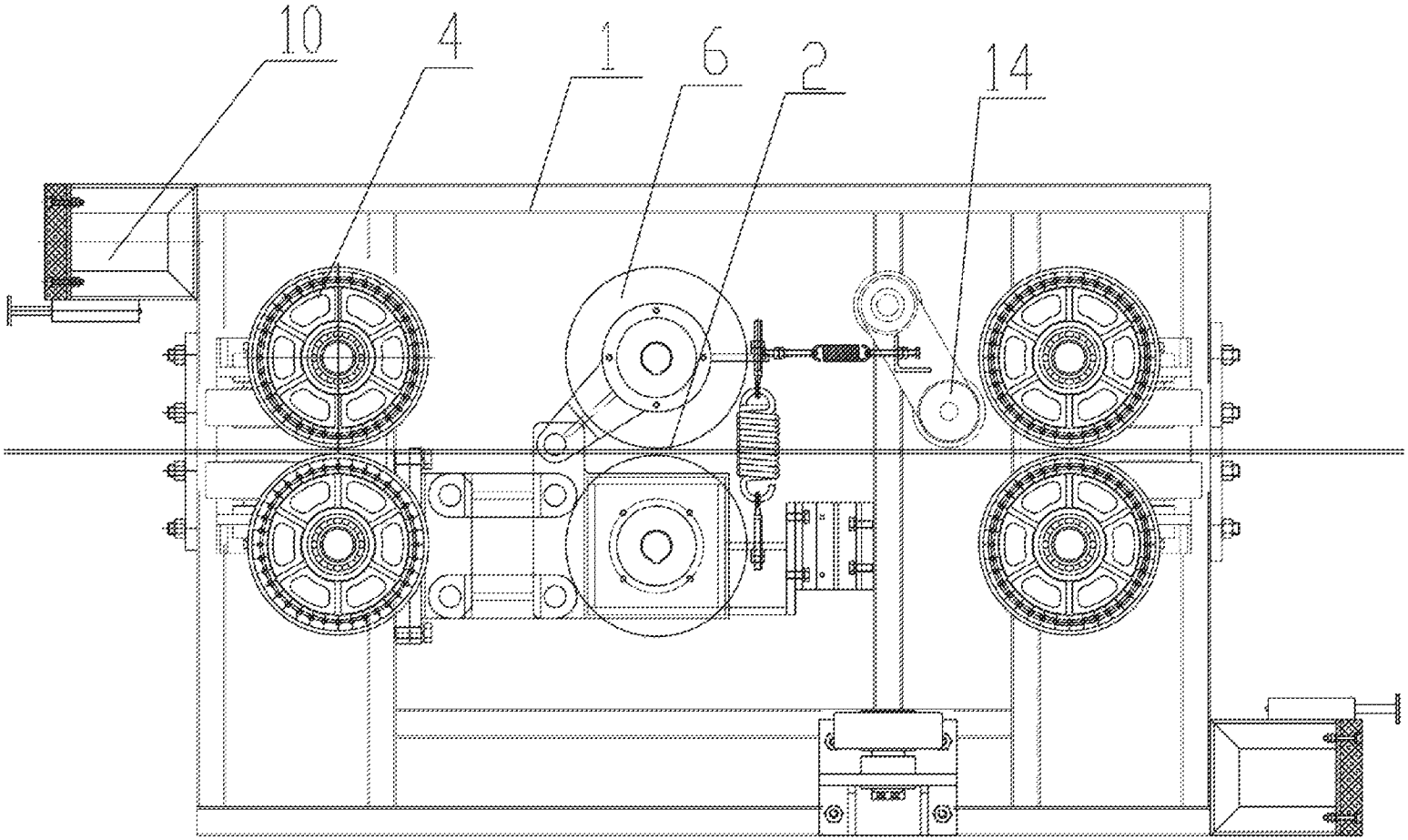
FIG. 3 is a top structure schematic diagram of the wireless remote control orbiter based on 5G frequency band of the present patent application, and the main rail is straight rail.
Figure 4:
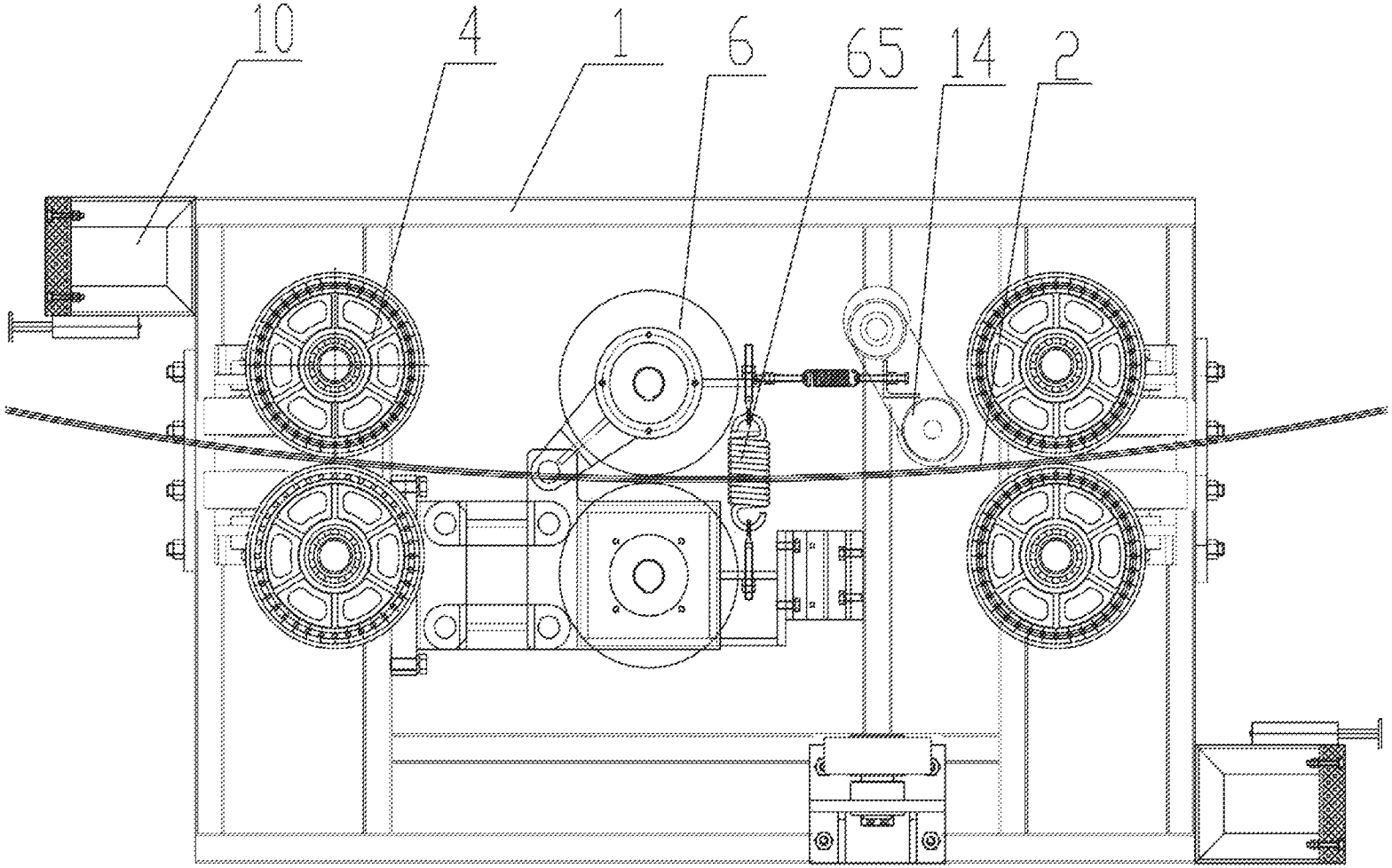
FIG. 4 is a top structure schematic diagram of the wireless remote control orbiter based on 5G frequency band of the present patent application, and the main rail is curved rail.
Figure 6:
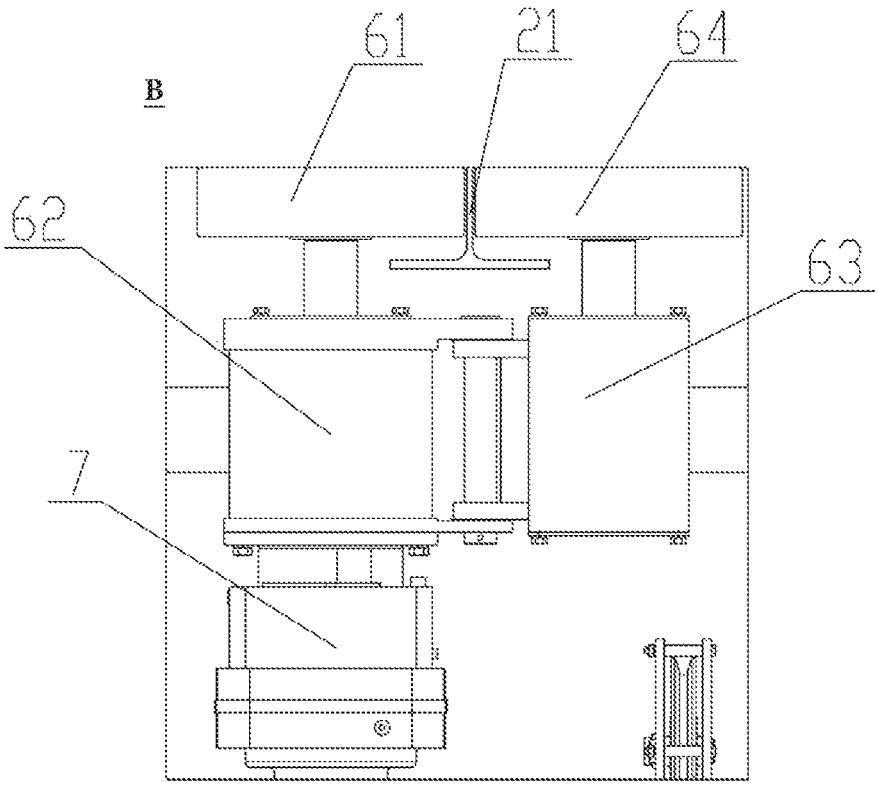
FIG. 6 is an enlarged schematic view of portion B of FIG. 2.

As shown in FIG. 6, the translational friction wheel groups 6 comprise a main translational friction wheel 61 which is mounted on the translational drive means 7, a first bearing pedestal 62 for supporting the main translational friction wheel 61, a second bearing pedestal 63 which is articulated on the first bearing pedestal 62 and a driven translational friction wheel 64 which is supported on the second bearing pedestal 63 by bearing. The main translational friction wheel 61 and the driven translational friction wheel 64 separately lean against both sides of the vertical rail 21. The translational drive means 7 is articulated on the rack 1, so that the friction wheel can adapt curvature change of the guide rail and curve translation is realized, therefore the present patent application not only adapt to straight rail translation, as shown in FIG. 3, but also adapt to curve rail translation, as shown in FIG. 4, the minimum turning radius ≤4 m.

A first tension spring 65 is disposed between the first bearing pedestal 62 and the second bearing pedestal 63, so that the main translational friction wheel and the driven translational friction wheel always lean against both sides of the vertical rail.

A plurality of horizontal stable wheel groups are disposed on the rack 1, each of the horizontal stable wheel group comprises two horizontal stable wheels 4 which are movably mounted on the rack 1, the two horizontal stable wheels 4 separately lean against both sides of the vertical rail 21, so the longitudinal stability and security can be ensure when the hanging tool is high-speed running.

A horizontal affiliated rail 12 is fixedly mounted on the main rail 2. A plurality of vertical stable wheels are disposed on the rack 1. Each of the vertical stable wheel group comprises two vertical stable wheels 13 which are movably mounted on the rack 1, the two vertical stable wheels 13 separately lean against both sides of the affiliated rail 12, so the lateral stability and security can be ensure when the hanging tool is high-speed running.

Figure 5:
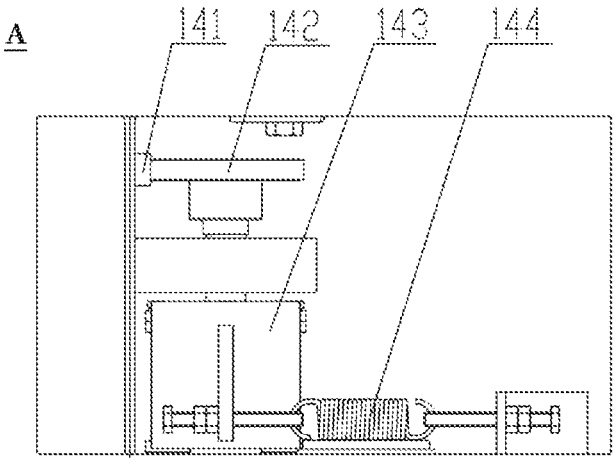
FIG. 5 is an enlarged schematic view of portion A of FIG. 2.

The orbiter further comprises a ranging mechanism 14, as shown in FIG. 5. The ranging mechanism 14 comprises a ranging synchronous belt 141 which is fixedly mounted on the main rail 2, and a belt wheel 142 which is meshed with the ranging synchronous belt 141, and a first encoder 143 which is connected to the belt wheel 142. The belt wheel 142 is movably mounted on the rack 1, so the positioning accuracy can be improved when the hanging tool parallel runs, and repetitive positioning accuracy≤6 mm.

A second tension spring 144 is disposed on the rack 1. One end of the second tension spring 144 is connected to the rack 1, and another end is connected to the belt wheel 142, so that the belt wheel is always meshed with the ranging synchronous belt.

Of course, the ranging mechanism can be meshed with a chain or a sprocket, but noise is smaller when the belt wheel is meshed with the ranging synchronous belt.

A first limit switch 10 is separately mounted on the two ends of the rack 1 for preventing collision of the rack with other objects.

The hoisting mechanism 9 is a dual rope winch, namely dual wire rope can be used for lifting the hanging tool, so that the hanging actors or props can be stable and little shake and not spin. A hoisting limit block 17 is disposed on each of the hoisting mechanism. A second limit switch 16 is mounted above each of the hoisting limit block 17 on the rack 1 to prevent accidents which are caused by transfinite winding of the winch. The hoisting limit block 17 is also balancing weight of no-load to avoid rope winding due to spring-back of the wire rope when winch is no-load.

A second encoder is mounted on the drive motor of the translational drive means 7 to control rotation speed and lifting height of the drive motor in order to ensure lifting start-stop smoothly and locating exactly.

A remote control signal receiver and electrical control box 5 are fixedly mounted on the rack 1. The remote control signal receiver and electrical control box 5 are wireless connected with the upstage operating system, modular management can be realized, and the characteristics of good generality, portability, compatibility and so on can be realized. Because of using virtual devices to simulate running interface, graphical editing, storing scenes and automatic running, etc. can be realized, devices operating parameters can be immediately changed in the specific mode, and devices status can be real-time viewed.

The remote control signal receiver can receive the wireless signal of 5G frequency band, so the interference of wireless signal source in venues for performing arts 2G~3G frequency band (such as wireless Wi-Fi®, mobile phone GPRS signal, wireless intelligent light, wireless microphone, walkie-talkie, etc.) can be effectively avoided, and it is ensured that the orbiter can be whole course controlled and run more securely and reliably.

Wherein, the main translational friction wheel, driven translational friction wheel, load-bearing wheel, horizontal stable wheel and vertical stable wheel have a wheel surface which is made of steel core encapsulated polyurethane, the wheel has the characteristics of good wear resistance, long life, no vibration, no noise, running more smoothly and so on, the overall running noise ≤50 dB.

In operation, translational motion along the main rail in left-right direction (in the orientation shown in FIG. 1) of the hanging tool can be realized by driving the translational drive means, lifting motion in up-down direction (in the orientation shown in FIG. 1) of the hanging tool can be realized by driving the lifting drive means, three-dimensional motion can also be realized by driving the translational drive means and the lifting drive means at the same time.

These are only a preferred embodiment of the present patent application, it should be noted that those of ordinary skill in the art, on the premise of without departing from the principles of the present patent application, can also make a number of improvements and modifications, these modifications and variations should be regarded as the scope of the present patent application.

What is claimed is:

1. A wireless remote orbiter based on 5G frequency band, comprising:

a main rail being fixedly mounted on a bearing beam of stage, the main rail comprising a vertical rail and a horizontal rail which is formed integrally below the vertical rail; and a rack hanging on the horizontal rail of the main rail and being mounted with translational drive means and lifting drive means;

wherein load-bearing wheels are fixedly mounted on the rack against the horizontal rail; translational friction wheel groups are connected to the translational drive means against the vertical rail;

the lifting drive means are connected to a hoisting mechanism mounted on the rack and comprising a wire rope, a hanging tool is connected to the wire rope of the hoisting mechanism, a corner pulley which can guide the wire rope of the hoisting mechanism is provided on the rack; and a sliding contact line is laid on the main rail and a conductor is disposed on the sliding contact line, a collector supplied power from the conductor is mounted on the rack;

wherein:

the translational friction wheel groups comprise a main translational friction wheel which is mounted on the translational drive means, a first bearing pedestal for supporting the main translational friction wheel, a second bearing pedestal which is articulated on the first bearing pedestal and a driven translational friction wheel which is supported on the second bearing pedestal by bearing; and the main translational friction wheel and the driven translational friction wheel separately lean against both sides of the vertical rail.

2. The wireless remote orbiter based on 5G frequency band according to claim 1, wherein:

a first tension spring is disposed between the first bearing pedestal and the second bearing pedestal.

3. The wireless remote orbiter based on 5G frequency band according to claim 1, wherein:

a plurality of horizontal stable wheel groups are disposed on the rack, each horizontal stable wheel group comprises two horizontal stable wheels which are movably mounted on the rack, the two horizontal stable wheels separately lean against both sides of the vertical rail.

4. The wireless remote orbiter based on 5G frequency band according to claim 1, wherein:

a horizontal affiliated rail is fixedly mounted on the main rail, a plurality of vertical stable wheel groups are disposed on the rack, each vertical stable wheel group comprises two vertical stable wheels which are movably mounted on the rack, the two vertical stable wheels separately lean against both sides of the affiliated rail.

5. The wireless remote orbiter based on 5G frequency band according to claim 1, wherein:

a remote control signal receiver is disposed on the rack, the remote control signal receiver receives wireless signal on 5G frequency band.

6. The wireless remote orbiter based on 5G frequency band according to claim 1, wherein:

a first limit switch is separately mounted on two ends of the rack for preventing translational collision.

7. The wireless remote orbiter based on 5G frequency band according to claim 6, wherein:

a hoisting limit block is disposed on the wire rope of the hoisting mechanism and above the hanging tool, a second limit switch is mounted above the hoisting limit block on the rack for anti-hoisting of lifting.

* * * * *